US007003849B2

(12) United States Patent
Cohen et al.

(10) Patent No.: US 7,003,849 B2
(45) Date of Patent: Feb. 28, 2006

(54) SELF LOCKING HINGE

(75) Inventors: Arnold H. Cohen, Andover, MA (US); James Q. Maloy, Clifton, NJ (US); Michael Smith, Passaic, NJ (US)

(73) Assignee: Fulcrum Sports, Inc., Clifton, NJ (US)

( * ) Notice: Subject to any disclaimer, the term of this patent is extended or adjusted under 35 U.S.C. 154(b) by 0 days.

(21) Appl. No.: 10/695,693

(22) Filed: Oct. 29, 2003

(65) Prior Publication Data

US 2005/0091792 A1 May 5, 2005

(51) Int. Cl.
*B25G 3/18* (2006.01)

(52) U.S. Cl. ..... 16/232; 16/436; 16/438; 16/429; 181/177.1; 403/102

(58) Field of Classification Search ..... 16/232, 16/231 X, 230, 321, 327, 329, 248, 436, 16/438, 439 X; 81/177.2, 177.6, 177.1 X, 81/177.8; 403/102, 327; 15/145, 146
See application file for complete search history.

(56) References Cited

U.S. PATENT DOCUMENTS

| | | | | | |
|---|---|---|---|---|---|
| 96,777 | A | | 11/1869 | Clyde | |
| 793,576 | A | | 6/1905 | Follmer | |
| 3,187,373 | A | * | 6/1965 | Fisher | 16/324 |
| 3,643,292 | A | * | 2/1972 | Mayer | 16/325 |
| 3,833,964 | A | | 9/1974 | Harcourt | |
| 4,111,217 | A | * | 9/1978 | Victor | 135/114 |
| 4,131,378 | A | * | 12/1978 | Daws | 403/93 |
| 4,543,006 | A | * | 9/1985 | Wang | 403/93 |
| 4,736,490 | A | | 4/1988 | Wesselski | |
| 4,773,503 | A | | 9/1988 | Purkapile | |
| 4,925,329 | A | | 5/1990 | Chuang | |
| 4,979,623 | A | * | 12/1990 | Flanagan | 209/419 |
| 5,139,283 | A | | 8/1992 | Dow | |
| 5,288,161 | A | * | 2/1994 | Graves et al. | 403/324 |
| 5,370,396 | A | * | 12/1994 | Bloom | 473/232 |
| 5,561,874 | A | * | 10/1996 | Malofsky et al. | 5/99.1 |
| 5,615,427 | A | * | 4/1997 | Huang | 5/99.1 |
| 5,671,490 | A | * | 9/1997 | Wu | 5/426 |
| 5,685,660 | A | * | 11/1997 | Liao | 403/102 |
| 5,727,265 | A | * | 3/1998 | Ziegler et al. | 5/99.1 |
| 5,970,540 | A | * | 10/1999 | Cheng | |

* cited by examiner

*Primary Examiner*—Suzanne Dino Barrett
*Assistant Examiner*—Mark Williams
(74) *Attorney, Agent, or Firm*—Thomas E. Hagar

(57) ABSTRACT

The present invention is an ingenuously designed self locking hinge that is simple to manufacture and can come in a variety of shapes given the application requirements. It has few parts making it cost effect and simple to use. The hinge can easily be opened and closed with one hand while at the same time creating a strong hinge connection. The invention can be used in a number of applications, including use with poles for many common applications such as walking sticks, canes, ski poles and wading staffs used by fly fishermen who need poles to navigate through a stream to avoid holes or rocks in the stream bed. The invention can also be used in conjunction with devices that require a collapsible frame.

6 Claims, 5 Drawing Sheets

SELF LOCKING HINGE

BACKGROUND a) Field of the Invention

This invention relates to the field of folding hinges designed for use in conjunction with devices that use poles or similar means and where it is desirable to collapse the same. More specifically, this device relates to devices that are used in conjunction with ski poles, canes, walking sticks, or wading staffs used by fishermen. This invention consists of a self-locking hinge that can be operated with one hand making use of the poles and related devices convenient.

b) Description of the Related Art

The present invention is directed towards folding or collapsible hinges that are designed for use in conjunction with poles or similar devices. Presently, there are different folding hinge designs that can be used in conjunction with poles or other devices to create collapsible frames. However, none of the prior art incorporates all of the novel aspects of the present invention of a simple, inexpensive, easy to manufacture, strong self locking hinge that most importantly can be operated with one hand.

A common collapsible hinge assembly in the prior art uses spring loaded poles that facilitate both the opening of the hinge assembly and the maintaining of the hinge assembly in a closed position. Some devices do not use an actual hinge at the connection point but rely on the spring loaded, or bungee cord loaded, poles and a sleeve type arrangement where one pole possess a sleeve designed to slide over a second pole. This arrangement is common with poles used for wading staffs, to support pop up camping tents and other similar devices. The main draw back is that two hands are required to assemble the two sections of the pole due to the combination of the internal spring mechanism and the overlapping sleeve arrangement. Other devices have an internal spring loaded means, such as U.S. Pat. No. 4,736,490, but have many internal parts that make is complicated and costly to manufacture. The present invention has only three basic parts and can be simply manufactured and placed inside a pole without any internal components.

Some devices use sleeves to facilitate the locking means such as in U.S. Pat. No. 5,139,283. This device is similar to the present invention, as it is used in conjunction with ski poles. The draw back with this device is that one needs to use two hands to operate the device, as one would have to hold the poles in place while they slide the sleeve over the hinge portion. Other devices do not use springs or sleeves, such as U.S. Pat. No. 3,833,964, but use the pole material to create the spring action. This device falls from the shortcoming of not yielding a true end-to-end 180-degree connection desirable for walking sticks and canes. Furthermore, this hinge device could be disengaged if one where to apply force to underside of the hinge, a concept not desirable to wading staffs, walking sticks and canes.

Still other devices utilize a latch mechanism as the present invention. One such example is U.S. Pat. No. 96,777, a device specifically designed for use with an umbrella. This device does not create a straight 180-degree orientation and does not easily collapse down for easy storage. Further, it does not have an offset hinge connection as the present invention preventing the device from being collapsed to a compact sized for easy transport and storage.

Some devices possess an offset hinge pivot connection. An example can be seen in U.S. Pat. No. 5,685,660 and its cited prior art references contained within the patent. All of these references suffer from the common problems of not being able to be engaged or disengaged with one hand. The cited reference itself does have a push button to release the mechanism but in doing so one's own finger will be holding the press plate of the opposite hinge portion preventing the same from disengaging from the main hinge portion, thereby preventing the device from being a one hand operation.

In sum, the present invention overcomes all the shortcomings of the prior art and discloses a simple self locking hinge. The design is simple to manufacture, can come in a variety of shapes given the application requirements and has few parts making it cost effect. The hinge can be simply opened and closed with one hand while creating a strong axial connection between two poles that is sufficient to be used as a wading staff, walking stick, cane or other device.

SUMMARY OF THE INVENTION

The invention consists of an ingenuously designed self locking hinge that can be used in a number of applications. The hinge can be used in conjunction with poles for many common applications such as walking sticks, ski poles and poles used by fly fishermen who need wading staffs to navigate through a stream to avoid holes or rocks in the stream bed that are not readily apparent to the naked eye. The invention can also be used in conjunction with devices that require a collapsible frame such as baby carriages or golf bag carts to name a few.

One key advantage of the invention is that it can be opened and closed with one hand and with one fluid motion. In the case of a wading staff a person simply holds the upper half of the wading staff containing the handle and releases the bottom half of the wading staff. The self locking hinge automatically engages once the bottom half of the wading staff is in place, that is, lined up end to end with the top half of the wading staff (See FIG. 4 and FIG. 5). This single hand operation is desirable and convenient in many applications, and more specifically, with a fly fisherman who is generally holding a fishing rod in one hand and thus only has one hand free to manage a wading staff.

Another advantage of the invention is that it allows for a wading staff, or other pole device, to be broken down to a compact size for easy transportation and storage. This is desirable in almost all applications, especially wading staffs and canes. If needed several hinges may be placed in the pole thereby allowing the pole to be folded a number of times, further reducing the size of the pole for transport and storage.

The invention consists of essentially three pieces; two hinge portions that are pivotally joined and a self locking latch that locks the two hinge portions together. The two hinge portions are designed to be disposed end to end and are pivotally engaged with each other around a pivot pin. The hinge portions are geometrically designed so that they do not protrude beyond the pole diameter. The only exceptions are the lobe portions of the hinge that create an offset pivot point. The offset pivot point allows the poles attached to the hinge to touch and to be parallel when the entire pole is in its closed position. The third portion of the invention is the self locking latch which is spring actuated. The self locking latch is permanently attached to one hinge portion. The self locking latch locks the invention by engaging a recess or notch in the opposing hinge portion. When engaged the hinge creates a strong connection that is sufficient for its application purpose. The invention is simply unlocked by pressing down on the self locking latch.

Accordingly, one object of this invention is to provide a self locking hinge that can be easily engaged and disengaged with one hand.

Another object of this invention is to provide a self locking hinge that is simple and inexpensive to manufacture.

A third object of this invention is to provide a self locking hinge that can be incorporated with poles, or other devices, so that one may possess a poled, or other, device that is strong in nature while being capable of being broken down to a compact size for easy transport and storage.

Other objects and advantages of this invention will become apparent from the following detailed description taken in conjunction with the accompanying drawings.

BRIEF DESCRIPTION OF THE DRAWINGS

These and other features, aspects and advantages of the present invention will become better understood with reference to the following description, appended claims, and accompanying drawings where.

DETAILED DESCRIPTION OF THE PREFERRED EMBODIMENT

Figure 1:
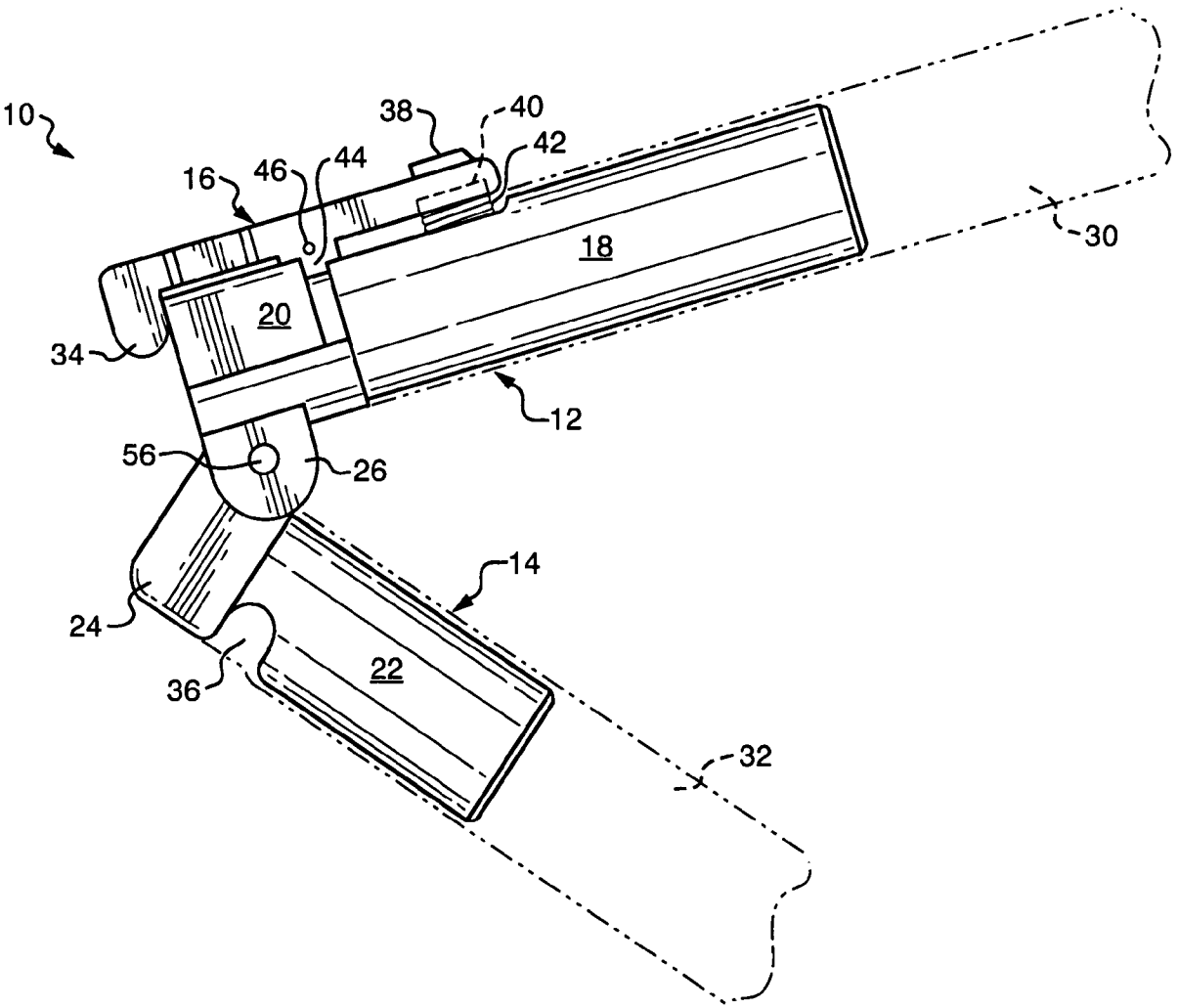
FIG. 1 is a plan view of the invention.
Figure 3:
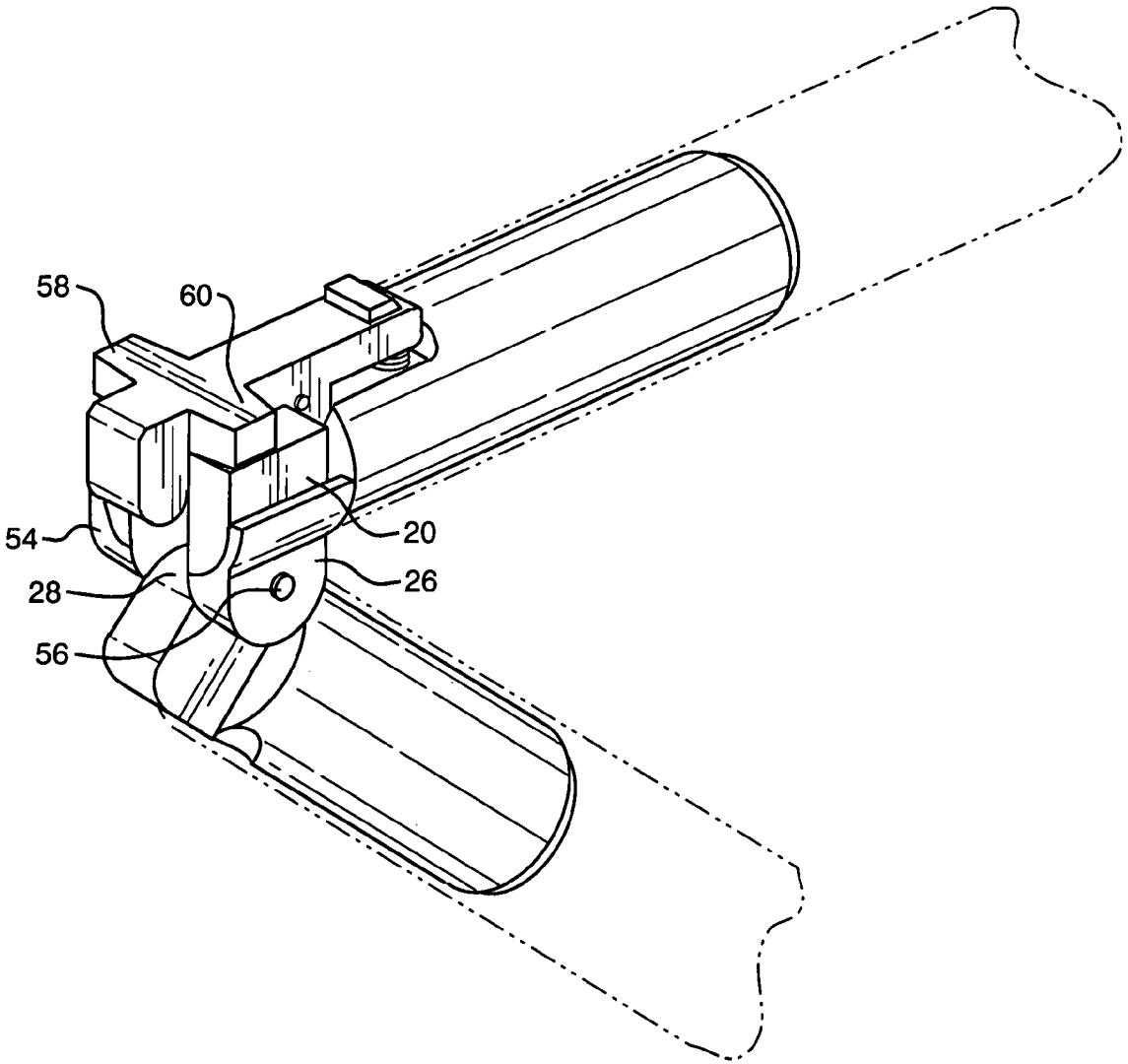
FIG. 3 is a perspective view of the invention.

Referring to the Figures and more specifically FIG. 1 and FIG. 3, the invention 10 consists of essentially three parts, a first hinge portion 12, a second hinge portion 14 and a self locking latch 16. Each hinge portion has a main body portion and a connecting portion containing lobes designed to connect the two hinge portions. The first hinge portion 12 has a main body portion 18 and a connecting portion 20 with two lobes 26 and 54. The second hinge portion 14 has a main body portion 22 and a connecting portion 24 with a single lobe 28. The main body portions of the hinge portions are design to allow the hinge portions to be engaged with poles or other devices. In FIG. 1, the main body portion 18 of first hinge portion 12 is disposed in pole 30 while the main body portion 22 of second hinge portion 14 is disposed in pole 32. The invention 10 can be made in a variety of geometric shapes so that it can be connected with variety of different shaped poles or devices requiring the invention 10. The preferred embodiment of the invention 10 is to have the main body portions of the hinges cylindrical in shape so that they may be accepted into a hollow cylindrical pole device.

Figure 4:
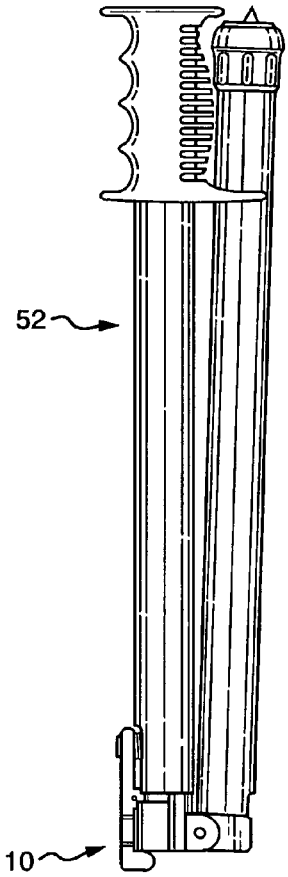
FIG. 4 is an elevation view of the invention in its closed position and used in conjunction with poles for a wading staff.
Figure 5:
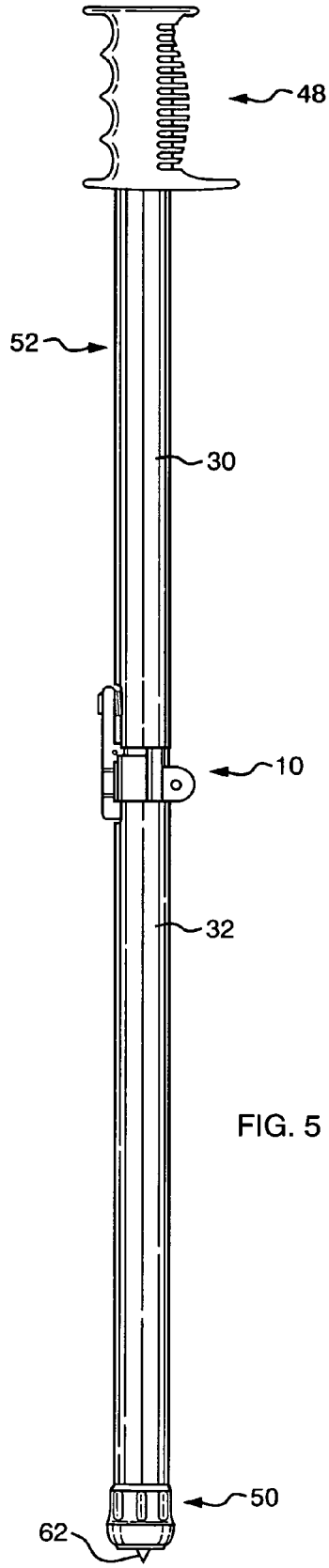
FIG. 5 is an elevation view of the invention in its engaged position and used in conjunction with poles for a wading staff.

The lobes 28, 26 and 54 extend from the bottom of their respective connecting portions and are designed to engage each other. The single lobe 28 is designed to be disposed between the two lobes 26 and 54. Each lobe has a hole and when the invention 10 is assembled all three holes of the lobes are axially aligned with each other. A single pin 56 is disposed within the three holes of the lobes thereby providing a means to connect the lobes and thus connect the hinge portions. The pin and lobe connection provides a means to allow the hinge portions to be pivotally joined and allow for the hinge portions to engage and disengage. The lobes protrude from the base of their respective connecting portions and therefore are offset from the main center axis of the hinge portions. In the preferred embodiment the lobes are offset a sufficient distance so as to allow the hinge portions to pivot in a full 180-degree orientation from being parallel to each other to being axially aligned end to end. FIG. 4 and FIG. 5 illustrates the full movement of the invention 10 from its disengaged, or closed, position to its engaged, or open, position, with only the handle 48 of the wading staff 52 preventing the hinge portions from being in perfect parallel orientation. The handle 48 may alternatively be designed to allow for perfect parallel alignment of the poles.

Figure 2:
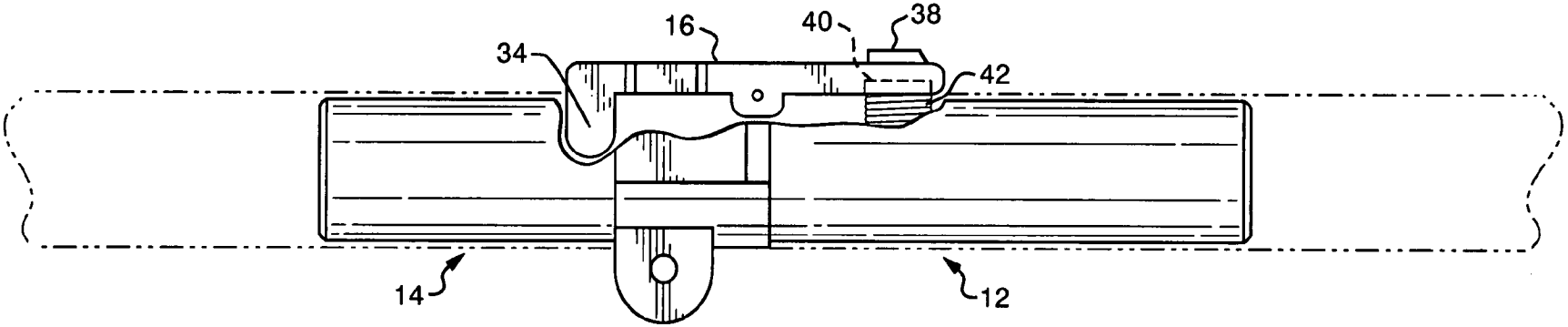
FIG. 2 is a cut away plan view of the invention in its engaged position and showing the self locking latch engaged.

The self locking latch 16 is the part of the invention 10 that locks the two hinge portions together end to end so that a strong connection is made. At the bottom of one end of the self locking latch 16 is a connecting lobe 34 designed to engage a recess 36 in the main portion 22 of the second hinge portion 14. The preferred embodiment is to have the connecting lobe 34 in a 90-degree orientation with the main portion of the self locking latch 16. At the opposite end of the self locking latch 16 is a press tab 38 that is disposed on the top of the self locking latch 16. A recess 40 is disposed on the bottom of the self locking latch 16 and directly opposite the press tab 38. The recess 40 is designed to accept a spring 42 which itself is disposed within the main body portion 18 of the first hinge portion 12 (see FIG. 2). The spring 42 is disposed between the main body portion 18 and the recess 40 and provides a means for keeping the self locking latch 16 engaged in the recess 36, and thus the invention 10 engaged. The spring 42 also provides a means to release the self locking latch 16 from the recess 36.

Figure 6:
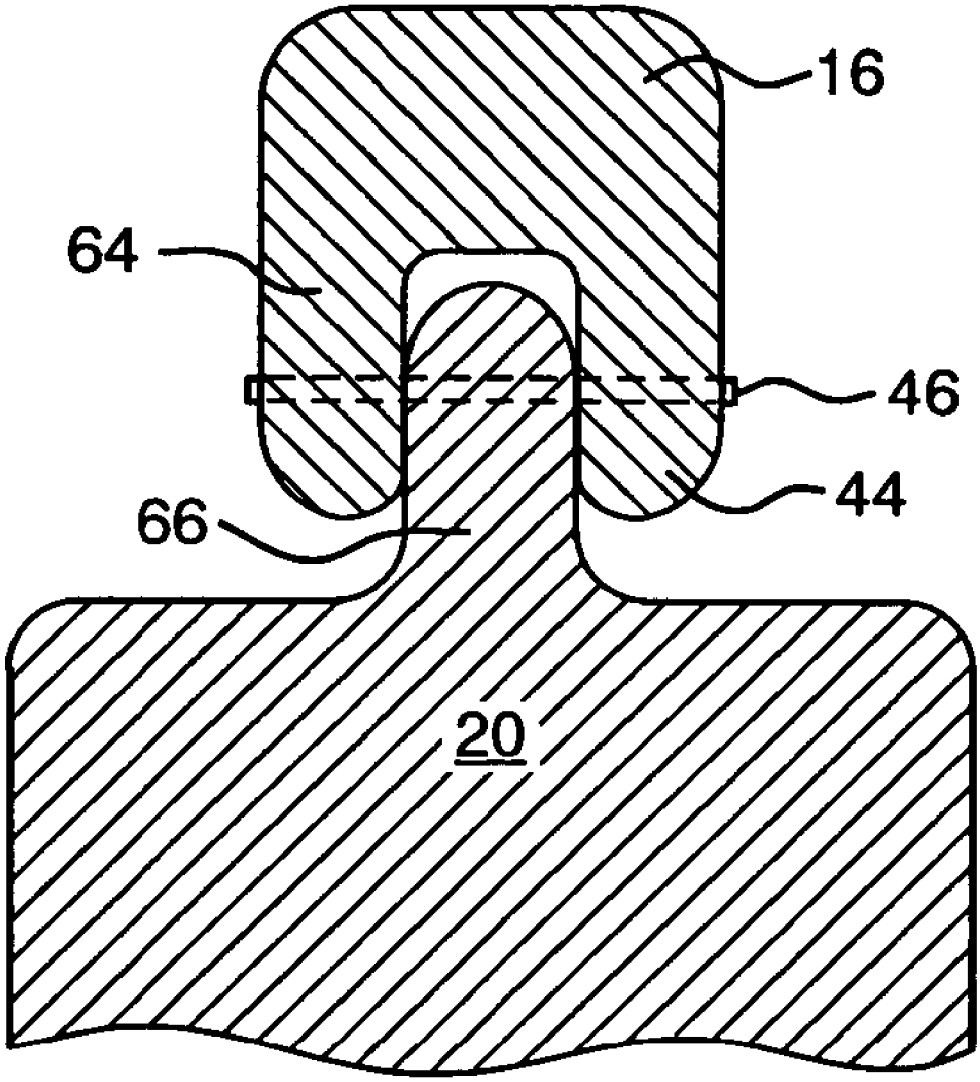
FIG. 6 is cross sectional view of the connection between the self locking latch and the first hinge portion.

On each side of the self locking latch 16 are two pivot lobes 44 and 64 designed to engage a single lobe 66 protruding up from the top part of the connecting portion 20 (See FIG. 6). A hole is disposed in all three lobes in such a manner that when the three holes are axially aligned the self locking latch 16 is in place in relation to the first hinge portion 12. A pin 46 is placed in holes of the lobes 44, 64 and 66 so that the self locking latch 16 can be connected to the first hinge portion 12 and which provides a means for the self locking latch 16 to move pivotally on top of the first hinge portion 12. This connection in conjunction with the spring 42 allows the self locking latch 16 to be engaged and be disengaged from recess 36.

The invention 10 can be easily assembled, by placing the main portions of the hinges into the devices to be connected. In FIG. 4 and FIG. 5 the invention is used in conjunction with a collapsible wading staff 52. The invention 10 is disposed within the two poles 30 and 32 of the wading staff 52. A handle 48 is at the top of the wading staff 52 and provides a means to lock the two poles together when folded. A rubber shoe 50 is at the base of the wading staff 52. A metal pivot 62, preferably steel, can be inserted into the rubber shoe 50 to prevent excessive wear on the shoe. FIG. 4 displays the invention 10 in its closed position for easy storage and/or transportation. FIG. 5 displays the invention 10 in its open or engaged position.

In the example of the wading staff 52, engaging and disengaging the invention 10 is easy and can be accomplished with one hand. To engage the invention 10 and thus open up the wading staff 52, one need only hold on to pole 30, preferably near the handle 48, separate the pole 32 from the pole 30 with one's fingers and then let gravity or other force allow the pole 32 to drop down to its closed position. In its closed position the two poles will be axially aligned with each other in an end-to-end orientation. To disengage the invention 10 one need only to push down on the press tab 38 thereby depressing the spring 42 causing the self locking latch 16 to pivot on pin 46 resulting in the connecting lobe 34 exiting the recess 36 sufficiently so that the invention 10 is disengaged. The two poles 30 and 32 can be folded back to the closed position. To accomplish this with one hand one need only raise the wading staff 52 off the ground a sufficient distance such that gravity will allow the pole 32 to release from its axial orientation with pole 30 and return to it closed position, parallel or nearly parallel, to pole 32.

In the preferred embodiment the spring 42 is designed to be sufficiently depressed to allow the connecting lobe 34 to exit the recess 36 a sufficient distance so that the connecting portion 24 does not hinder the connecting lobe's 34 ability to release from the second hinge portion 14. For ease of operation, the bottom surface of the connecting lobe 34 is rounded. Also, the leading edge of the connecting portion 24 is rounded off a sufficient amount so as to aid in allowing the connecting lobe 34 to "roll" over the connecting portion 24 to the recess 36. Although this arrangement is not necessary as in the preferred embodiment the spring 42 can be pressed sufficiently enough to allow the connecting lobe 34 to pass over the connecting portion 24 without interference, the invention 10 is designed in this manner just in case a user for some reason does not fully depress the spring 42 sufficiently and thus needs the rounded surfaces of the connecting lobe 34 and connecting portion 24 to aid in the engagement of the invention 10. Once the connecting lobe 34 is disposed in recess 36 and the hinge portions are axially aligned end-to-end and the invention 10 is engaged. The spring 42 maintains a constant vertical pressure on the self-locking latch 16 and therefore keeps the connecting lobe 34 in the recess 36. All the tolerances on all the parts of the invention 10 are sufficiently tight and a secure connection is made locking the hinge portions in place. The invention 10 is designed so that it can be engaged and disengaged with the minimal of force placed on the press tab 38.

The self locking latch 16 has two flanges 58 and 60 that protrude out of the side of the self-locking latch 16. The flanges 58 and 60 are designed to provide a stop for the self-locking latch 16. When the self-locking hinge 16 is engaged, the flanges 58 and 60 rest on the top part of the connecting portion 20. The combination of the flanges 58 and 60 resting, or stopping, on the top part of the connecting portion 20 and the pressure created by the spring 42 maintain the self-locking latch 16 in a secure position and prevents the self-locking latch 16 from moving while the engaged invention 10 is in use.

The invention can be made from any strong material, for example metal or plastic, with the preferred embodiment being machined aluminum. The parts are simple in design and can be made using standard machining techniques.

What is claimed is:

1. A Self Locking Hinge comprising:

a first hinge portion, a second hinge portion, a self locking latch and a spring;

where each hinge portion comprises a connecting portion containing lobes designed to pivotally connect the two hinge portions together and a main body portion designed to connect the hinge portion to an object or objects to be hinged together;

where the first hinge portion contains a top part;

where the spring is disposed between the self locking latch and the top part of the first hinge portion;

where said self locking latch is spring actuated, pivotally attached to the top part of the first hinge portion and where the self locking latch contains a press tab, a main portion and a connecting lobe;

where said connecting lobe is designed to engage a recess in the second hinge portion;

where said engagement of the connecting lobe into the recess of the second hinge portion locks the hinge in its engaged position;

where the axis of the connecting lobe is perpendicular to the axis of the main portion of the self locking latch;

where said lobes of the hinge portions are off set from the center axis of their respective hinge portions thereby providing a means to allow the hinge portions to pivotally move in an 180-degree orientation with respect to each other from a disengaged position to an engaged position;

where the self locking latch contains two flanges designed to provide a stop for the self locking latch;

wherein an individual can disengage the hinge with a single hand from its engaged position by applying pressure by the finger of one's hand on to the press tab causing the self locking latch to pivot resulting in the connecting lobe disengaging from the recess in the second hinge portion and thus disengaging the hinge;

wherein an individual can engage the hinge with a single hand by applying pressure by the finger of one's hand on to the press tab causing the self locking latch to pivot, then allowing the two hinge portions to swing into a 180 degree orientation and then releasing the pressure on the press tab causing the self locking to pivot and the connecting lobe to engage the recess in the second hinge portion and thus engage the hinge.

2. A Self Locking Hinge as in claim 1 where the hinge portions and the self locking latch are made from metal or plastic.

3. A Self Locking Hinge as in claim 1 where the hinge is used in conjunction with wading staffs, canes, walking sticks, and ski poles.

4. A Self Locking Hinge as in claim 1 where the hinge is used in conjunction with golf carts, baby carriages and collapsible tents.

5. A Self Locking Hinge as in claim 1 where a plurality of said hinges are used in conjunction with a poled device so that the device can be folded in multiple sections to minimize the folded length.

6. A Self Locking Hinge as in claim 1 wherein one can engage the hinge with a single hand by holding on to the first hinge portion, or a pole attached thereto, and allow gravity or other force to cause the second hinge portion to swing into a 180 degree orientation with the first hinge portion and thus engage the invention.

* * * * *